US009386365B2

(12) United States Patent
Burgett et al.

(10) Patent No.: US 9,386,365 B2
(45) Date of Patent: Jul. 5, 2016

(54) EARPHONE

(71) Applicant: Harman International Industries, Incorporated, Stamford, CT (US)

(72) Inventors: Seth D. Burgett, Glen Carbon, IL (US); Effrosini A. Karayiannis, St. Louis, MO (US); Aaron Gorga, St. Louis, MO (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/321,945

(22) Filed: Jul. 2, 2014

(65) Prior Publication Data

US 2015/0010193 A1 Jan. 8, 2015

Related U.S. Application Data

(60) Provisional application No. 61/842,838, filed on Jul. 3, 2013.

(51) Int. Cl.
*H04R 25/00* (2006.01)
*H04R 1/10* (2006.01)

(52) U.S. Cl.
CPC ..... *H04R 1/1058* (2013.01); *H04R 1/1016* (2013.01); *H04R 1/105* (2013.01); *H04R 25/652* (2013.01)

(58) Field of Classification Search
CPC ..... H04R 1/10; H04R 1/1016; H04R 1/105; H04R 1/1066; H04R 25/652
See application file for complete search history.

(56) References Cited

U.S. PATENT DOCUMENTS 2,430,229 A * 11/1947 Kelsey ..... 381/338
2,790,038 A * 4/1957 Bonnaffous ..... 381/371
4,965,838 A * 10/1990 Kamon ..... H04R 1/1016 381/322
5,048,092 A * 9/1991 Yamagishi ..... H04R 1/1016 181/135
6,122,388 A * 9/2000 Feldman ..... H04R 25/604 381/322
6,688,421 B2 * 2/2004 Dyer ..... A61F 11/08 181/130
7,536,008 B2 * 5/2009 Howes ..... H04R 1/083 379/433.01
8,111,861 B2 2/2012 Lowry
D657,779 S 4/2012 Gondo
8,175,315 B2 * 5/2012 Tanaka ..... H04R 1/1016 381/370
8,194,910 B2 * 6/2012 Uchida ..... H04R 1/1091 381/370
8,406,447 B2 * 3/2013 Kromann et al. ..... 381/380
8,526,657 B2 9/2013 Yanagishita et al.
8,731,228 B2 5/2014 Burgett et al.
8,873,790 B2 10/2014 Hayashida et al.
2008/0298626 A1 * 12/2008 Dean ..... 381/381
2009/0202098 A1 * 8/2009 Chan ..... H04R 1/1066 381/380
2013/0195310 A1 * 8/2013 Lin ..... 381/380
2014/0270315 A1 * 9/2014 Burgett ..... H04R 1/105 381/380
2014/0286515 A1 * 9/2014 Bone ..... H04R 1/1016 381/328
2014/0307911 A1 * 10/2014 Inoda ..... 381/380
2015/0071477 A1 * 3/2015 Mainini et al. ..... 381/380
2015/0110320 A1 * 4/2015 Liu et al. ..... 381/322

* cited by examiner

*Primary Examiner* — Curtis Kuntz
*Assistant Examiner* — Ryan Robinson
(74) *Attorney, Agent, or Firm* — Brooks Kushman P.C.

(57) ABSTRACT

An earphone adapted to be worn in a user's ear has a body having a front face. There is a speaker in the front face of the body. A radially projecting brim surrounds the front face, the brim having an elongated shape configured fit in the concha of the user's ear, with portions of the rearward face of the brim engaged by the tragus and the antitragus of the user's ear.

7 Claims, 4 Drawing Sheets

EARPHONE

CROSS-REFERENCE TO RELATED APPLICATIONS

This Utility Patent Application claims priority to U.S. Provisional Application No. 61/842,838, filed Jul. 3, 2013, the disclosure which is incorporated herein.

BACKGROUND

This invention relates to earbuds and earphones and, in particular, to earbuds and earphones that securely but comfortable fit in the ear. Numerous attempts have been made to provide earbuds or earphones that securely, but comfortably engage the user's ear. There few things more annoying to a user of earbuds and earphones than having to constantly adjust and reseat the earbud or earphone, unless it is the discomfort to the sensitive parts of the ear caused by trying to wedge the earbud or earphone in place. While there are some successful designs, these designs are often complicated and expensive.

FIELD

Various embodiments of this invention provide an earbud or earphone that is adapted to be worn in a user's ear. A preferred embodiment of an earphone or earbud comprises a body having a front face. A speaker is disposed in the front face of the body. A radially projecting brim surrounds the front face. This brim can have an elongated shape configured fit in the concha of the user's ear, with portions of the rearward face of the brim engaged by the tragus and the antitragus of the user's ear.

The perimeter of the brim preferably has a compound shape, with a generally circular portion and a tapering tab portion with a blunt end adapted to extend into the user's ear beneath the tragus. The end of the tab portion of the perimeter of the brim is preferably generally straight. The brim preferably comprises a resilient material. In the preferred embodiment, the body has a groove therein behind the front face, and the brim comprises a hollow flat resilient element having forward and a rearward face, and an opening in the rearward face, the edge margins of which are configured to fit in the groove in the body. There is preferably also an opening in the forward face of the brim element for accommodating the speaker that is disposed in the front face. The opening in the rear face of the brim element is preferably generally oval, accommodating the generally oval shape of the body, and the opening in the forward face of the brim element is generally circular, accommodating the generally circular shape of the speaker.

The earphone preferably further comprising a stem extending from the body that is configured to extend between the tragus and antitragus when the brim is positioned in the concha of the user's ear, behind the tragus and antitragus. The stem preferably extends in a direction that is generally perpendicular to the direction of elongation of the elongated brim. The portion of the stem adapted to extend between the tragus and the antitragus preferably has a smooth, generally v-shaped profile to comfortably fit between and engage the tragus and the antitragus.

DETAILED DESCRIPTION

Figure 1:
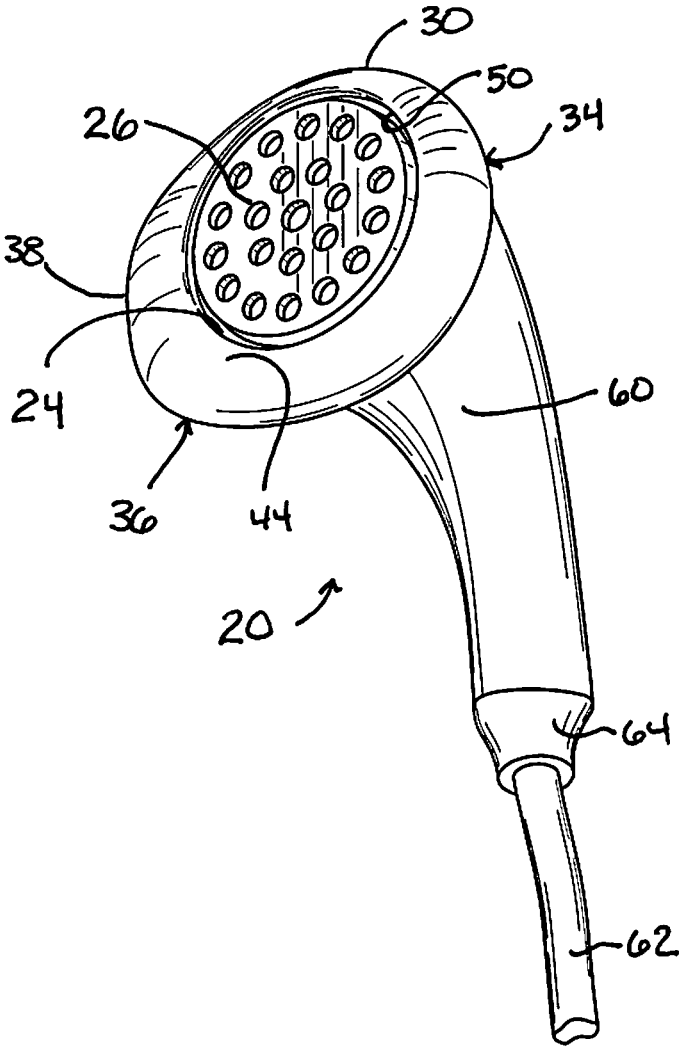
FIG. 1 is a perspective view of a preferred embodiment of an earphone in accordance with the present invention.
Figure 2:
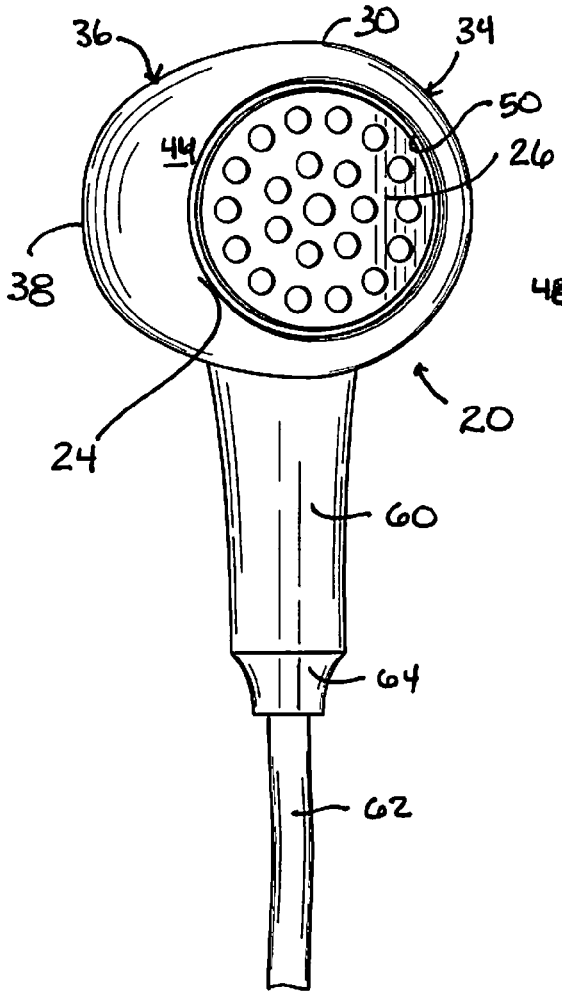
FIG. 2 is a front elevation view thereof.
Figure 3:
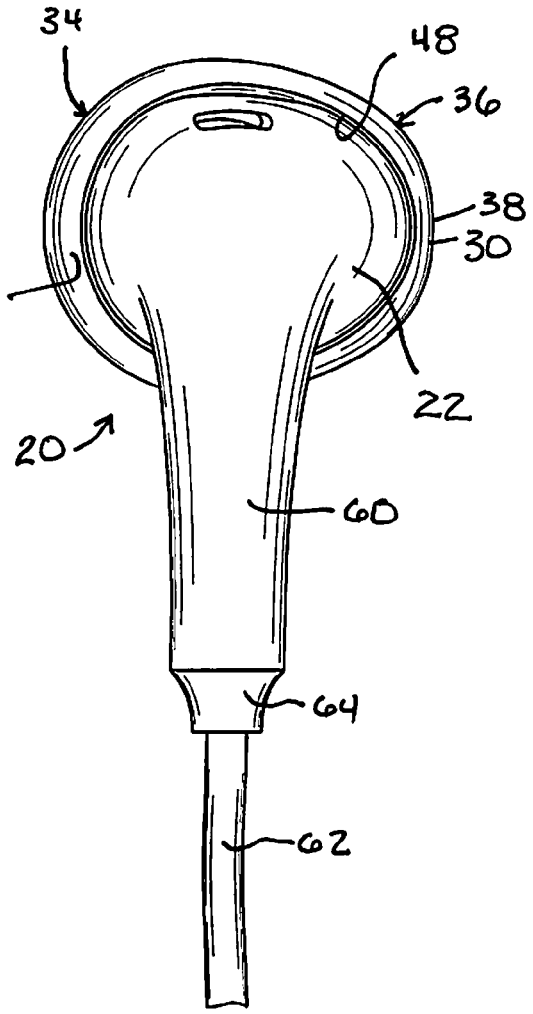
FIG. 3 is a rear elevation view thereof.
Figure 4:
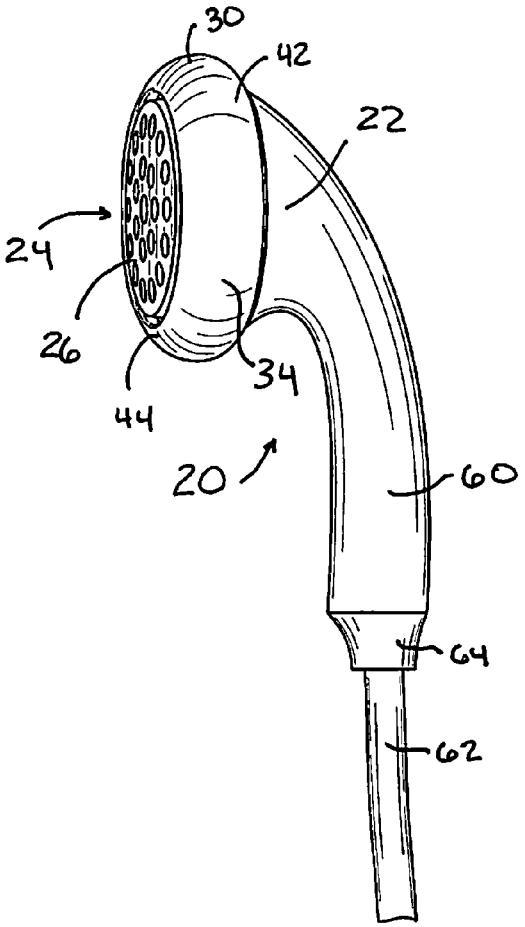
FIG. 4 is a right side elevation view thereof.
Figure 5:
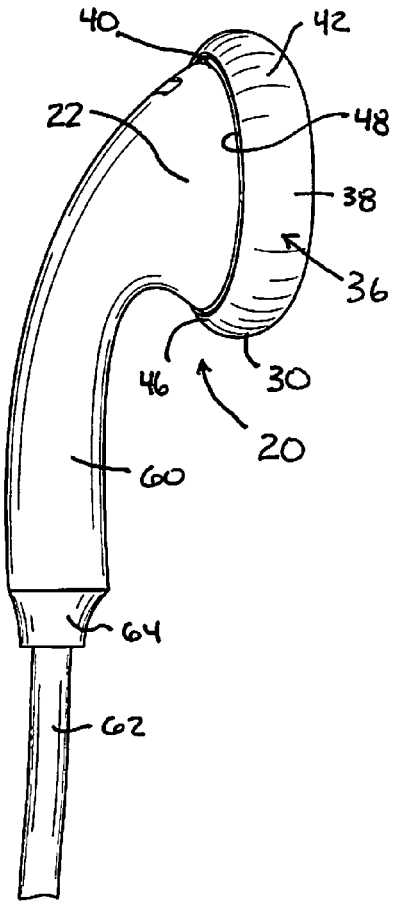
FIG. 5 is a left side elevation view thereof.
Figure 6:
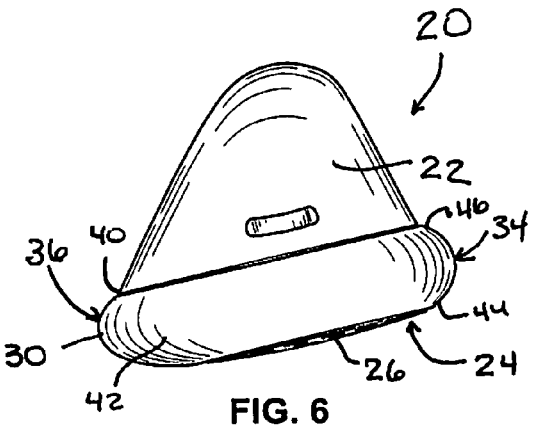
FIG. 6 is a top plan view thereof.
Figure 7:
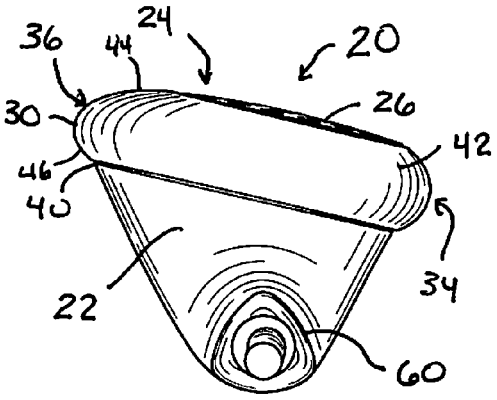
FIG. 7 is a bottom plan view thereof.
Figure 8:
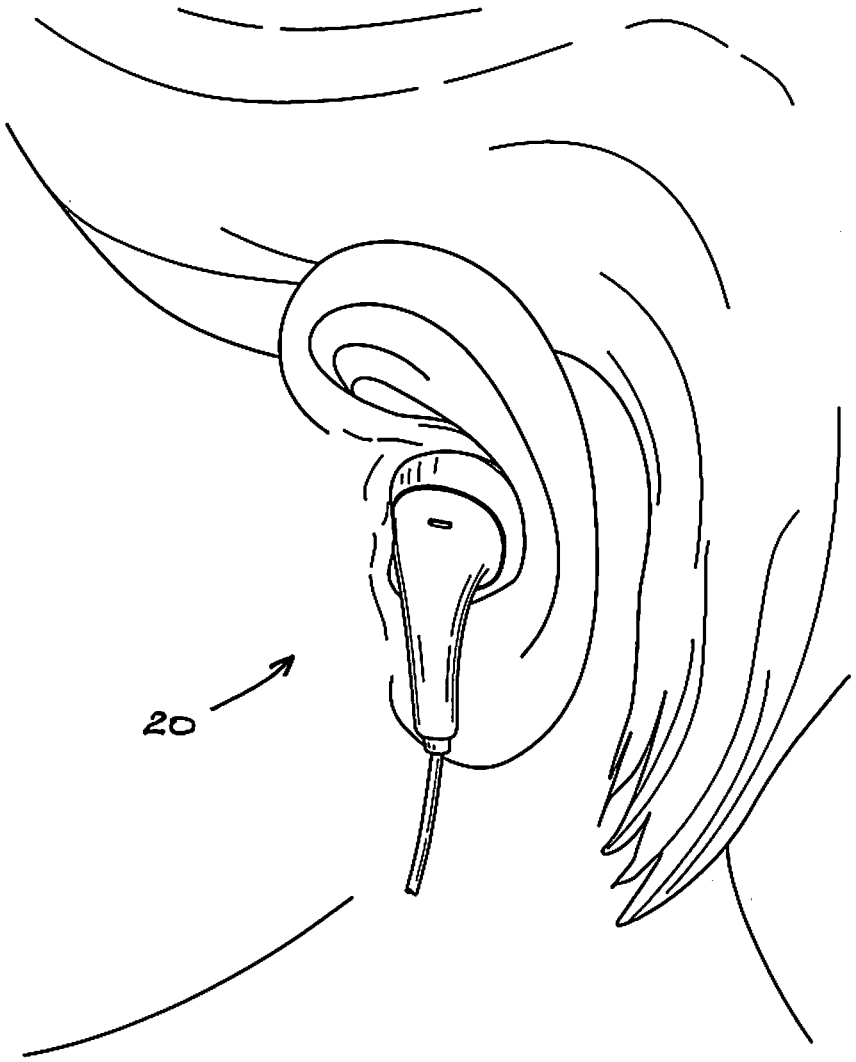
FIG. 8 is a perspective view, showing the earbud or earphone of the preferred embodiment, as it would be worn in a user's ear.

A preferred embodiment of an earphone or earbud constructed according to the principles of this invention is indicated generally as 20 in the Figures. Earbud or earphone 20 comprises a body 22 having a front face 24. The body 22 preferably has a generally oval or elliptical shape, and is preferably made of a smooth, hard plastic, or other suitable material. A speaker 26 is disposed in the front face 24 of the body 22. A radially projecting brim 30 surrounds the front face 24 of the body 22. This brim 30 can have an elongated shape configured fit in the concha of the user's ear, with portions of the rearward face 32 of the brim 30 (FIG. 8) engaged by the tragus and the antitragus of the user's ear.

The perimeter of the brim 30 preferably has a compound shape, with a generally circular portion 34 and a tapering tab portion 36 with a blunt end 38 adapted to extend into the user's ear beneath the tragus. The end 38 of the tab portion 36 of the perimeter of the brim 30 is preferably generally straight. The brim 30 preferably comprises a resilient material, such as a polymer foam.

In the preferred embodiment, the body 22 has a circumferential groove 40 therein behind the front face 24, and the brim 30 comprises a hollow flat resilient element 42 having forward and rearward faces 44 and 46, respectively, There is an opening 48 in the rearward face 46 of the element 42, the edge margins of which are configured to fit in the groove in the body. There is preferably also an opening 50 in the forward face 44 of the brim element 42 for accommodating the speaker 26 that is disposed in the front face 38 of the body 22. The opening 48 in the rear face of the brim element 42 is preferably generally oval, accommodating the generally oval shape of the body 22, and the opening 50 in the forward face 44 of the brim element is generally circular, accommodating the generally circular shape of the speaker 26.

The earphone 20 preferably further comprising a stem 60 extending from the body 22 that is configured to extend between the tragus and antitragus when the brim is positioned in the concha of the user's ear, behind the tragus and antitragus. The stem 60 is preferably formed integrally with the body 22, and extends in a direction that is generally perpendicular to the direction of elongation of the elongated brim 30. Alternatively the stem 60 could be a separate piece from the body. The stem 60 is adapted to extend between the tragus and the antitragus, when the body is in the concha of the user's ear. The stem 60 preferably has a smooth, generally v-shaped profile to comfortably fit between and engage the tragus and the antitragus. The stem can be made of the same material as the body, or it can be made of different material, for example a flexible or resilient material, or a material with a silky surface texture.

The stem 60 can accommodate a wire 62 leading to the speaker 26 in the body 22. The wire 62 preferably contains at least two wires to provide a driving signal to the speaker 26.

A flexible boot 64 can be provided at the end of the stem 60 to prevent the wire 62 from bending too sharply as it leaves the stem.

OPERATION

In operation, the earbud or earphone 20 is quickly and easily inserted into the user's ear, with the blunt end of the tab oriented generally toward the tragus and the ear canal at the bottom of the concha. The blunt end distributes any force applied by the end over a greater surface are, reduce the pressure felt by the user. The forward face of the body 22 and brim 30 is seated in the concha, with the tragus and the antigragus engaging the back surface of the brim, and holding the body in place. The stem 60 extends downwardly from the body, fitting smoothly and snugly between the tragus and the antitragus.

The earbud or earphone 20 is thus held securely and comfortably in the user's ear, with the speaker 26 facing the user's concha, and directing sound down the user's ear canal.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An earphone adapted to be worn in a user's ear, the earphone comprising:

a generally elliptical body having a front face;

a speaker in the front face of the body, the speaker including a grille mounted substantially flush with the front face; and a radially projecting brim surrounding the front face, the brim having a generally elliptical shape having a perimeter formed by a generally circular portion on one side of the front face and a blunt tapering tab portion on an opposite side of the front face, the brim having a forward face and a rearward face, an opening in the forward face for accommodating the speaker, and an opening in the rearward face, wherein the opening in the forward face is generally circular and the opening in the rearward face is generally oval, the brim configured to fit in the concha of the user's ear, with the blunt end of the tab extending partly into the ear canal and engaging the interior of the ear below the tragus, with portions of the rearward face of the brim engaged by the tragus and the antitragus of the user's ear.

2. The earphone according to claim 1 wherein the end of the tab portion of the perimeter of the brim is generally straight.

3. The earphone according to claim 1 wherein the brim comprises a resilient material.

4. The earphone according to claim 1 wherein the body has a groove therein behind the front face, and wherein the brim comprises a hollow flat resilient element, wherein the edge margins of the opening in the rearward face are configured to fit in the groove in the body.

5. The earphone according to claim 1 further comprising a stem extending from the body, the stem configured to extend between the tragus and antitragus when the brim is in the concha of the user's ear, behind the tragus and antitragus.

6. The earphone according to claim 5 wherein the stem extends in a direction that is generally perpendicular to the direction of elongation of the elongated brim.

7. The earphone according to claim 5 wherein the portion of the stem adapted to extend between the tragus and the antitragus has a v-shaped profile.

* * * * *